US007170376B2

(12) United States Patent
Mills et al.

(10) Patent No.: US 7,170,376 B2
(45) Date of Patent: Jan. 30, 2007

(54) ELECTRICAL SWITCHING APPARATUS INCLUDING A HOUSING AND A TRIP CIRCUIT FORMING A COMPOSITE STRUCTURE

(75) Inventors: Patrick W. Mills, Bradenton, FL (US); Kevin D. Gonyea, Bradenton, FL (US); Richard G. Benshoff, Sarasota, FL (US)

(73) Assignee: Eaton Corporation, Cleveland, OH (US)

( * ) Notice: Subject to any disclaimer, the term of this patent is extended or adjusted under 35 U.S.C. 154(b) by 6 days.

(21) Appl. No.: 11/008,463

(22) Filed: Dec. 9, 2004

(65) Prior Publication Data

US 2006/0125583 A1 Jun. 15, 2006

(51) Int. Cl.
*H01H 13/04* (2006.01)
*H01H 9/02* (2006.01)

(52) U.S. Cl. ..... 335/202

(58) Field of Classification Search ..... 335/16, 335/202

See application file for complete search history.

(56) References Cited

U.S. PATENT DOCUMENTS 4,092,623 A 5/1978 Kirkup
4,110,719 A 8/1978 Kirkup
4,415,875 A 11/1983 Kirkup et al.
4,568,899 A * 2/1986 May et al. ..... 335/18
4,652,975 A * 3/1987 Scott ..... 361/772
4,667,263 A * 5/1987 Morris et al. ..... 361/42
4,725,799 A * 2/1988 Bratkowski et al. ..... 335/14
5,224,006 A 6/1993 MacKenzie et al.
5,283,542 A * 2/1994 Ochiai et al. ..... 335/6
5,691,869 A 11/1997 Engel et al.
6,522,228 B2 * 2/2003 Wellner et al. ..... 335/18
6,522,509 B1 2/2003 Engel et al.
6,542,056 B2 4/2003 Nerstrom et al.
6,545,574 B1 * 4/2003 Seymour et al. ..... 335/18
6,633,222 B2 * 10/2003 Nagai et al. ..... 337/365
6,710,688 B2 3/2004 Wellner et al.
6,842,325 B2 * 1/2005 Meehleder et al. ..... 361/160
2004/0026757 A1 * 2/2004 Crane et al. ..... 257/434

* cited by examiner

*Primary Examiner*—Ramon M. Barrera
(74) *Attorney, Agent, or Firm*—Marvin L. Union

(57) ABSTRACT

A circuit breaker includes a molded housing, separable contacts, an operating mechanism adapted to open and close the separable contacts, and a trip circuit cooperating with the operating mechanism to trip open the separable contacts. The molded housing includes two molded halves. The trip circuit includes a pair of arc fault printed circuit boards which cooperate with the corresponding molded halves to form an external composite structure. That external composite structure includes the printed circuit boards and an over-molding material, such as, for example, a thermally conductive epoxy coating disposed thereon.

23 Claims, 8 Drawing Sheets

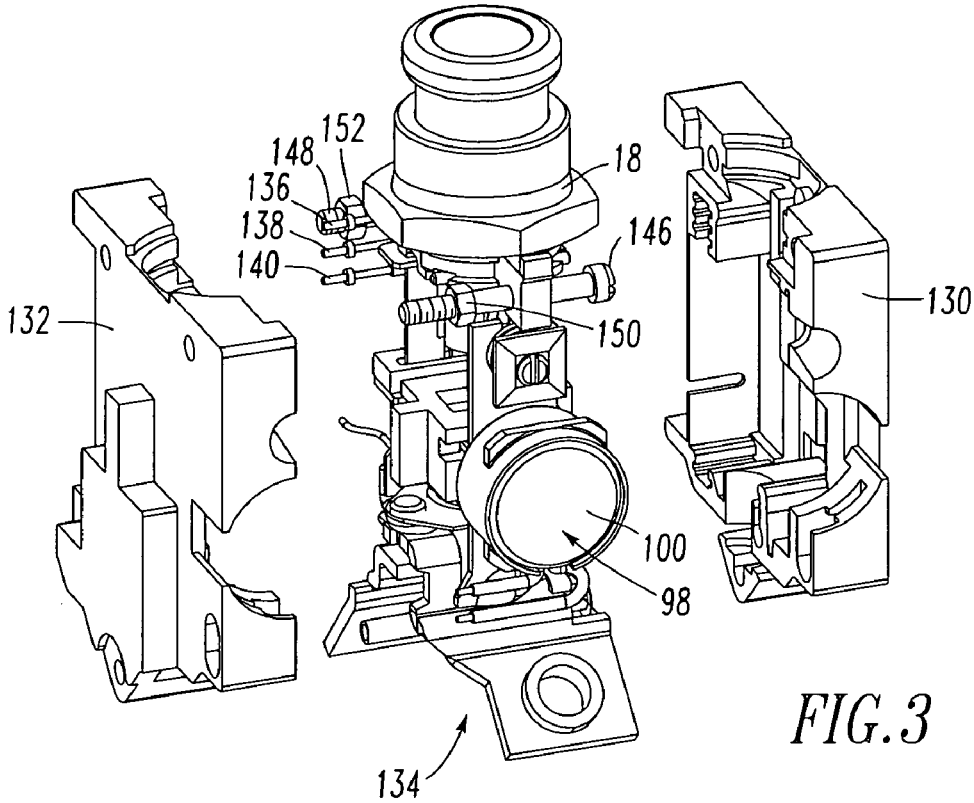
FIG. 3
FIG. 4
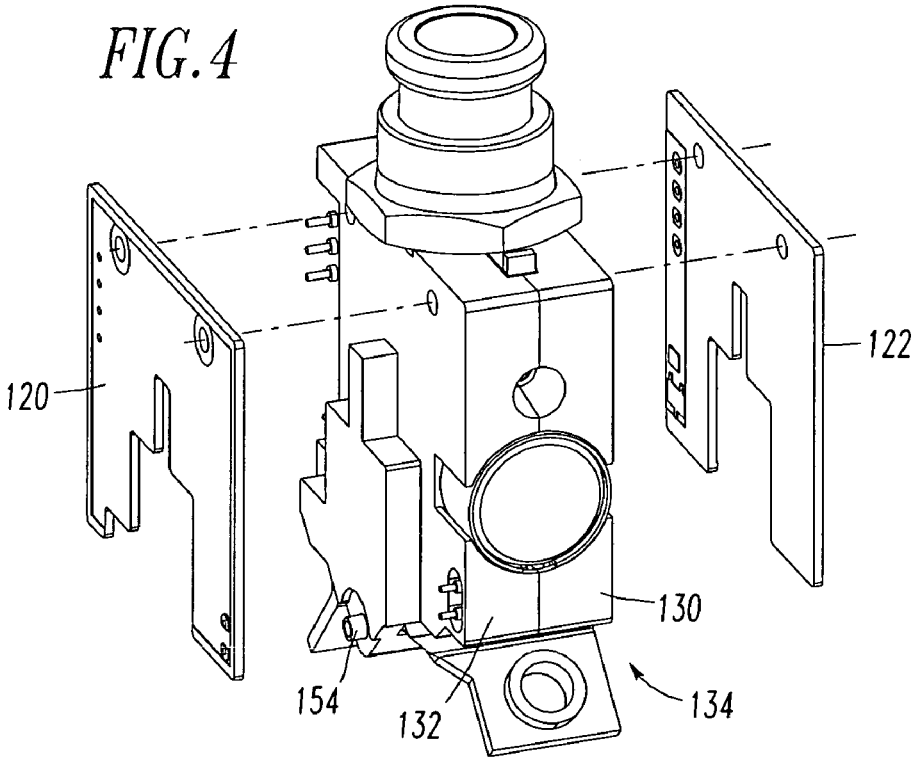

ELECTRICAL SWITCHING APPARATUS INCLUDING A HOUSING AND A TRIP CIRCUIT FORMING A COMPOSITE STRUCTURE

BACKGROUND OF THE INVENTION

1. Field of the Invention

This invention relates to electrical switching apparatus and, more particularly, to circuit interrupters, such as, for example, aircraft or aerospace circuit breakers providing arc fault protection.

2. Background Information

Circuit breakers are used to protect electrical circuitry from damage due to an overcurrent condition, such as an overload condition or a relatively high level short circuit or fault condition. In small circuit breakers, commonly referred to as miniature circuit breakers, used for residential and light commercial applications, such protection is typically provided by a thermal-magnetic trip device. This trip device includes a bimetal, which heats and bends in response to a persistent overcurrent condition. The bimetal, in turn, unlatches a spring powered operating mechanism, which opens the separable contacts of the circuit breaker to interrupt current flow in the protected power system.

Subminiature circuit breakers are used, for example, in aircraft or aerospace electrical systems where they not only provide overcurrent protection but also serve as switches for turning equipment on and off. Such circuit breakers must be small to accommodate the high-density layout of circuit breaker panels, which make circuit breakers for numerous circuits accessible to a user. Aircraft electrical systems, for example, usually consist of hundreds of circuit breakers, each of which is used for a circuit protection function as well as a circuit disconnection function through a push-pull handle.

Typically, subminiature circuit breakers have provided protection against persistent overcurrents implemented by a latch triggered by a bimetal responsive to $I^2R$ heating resulting from the overcurrent. There is a growing interest in providing additional protection, and most importantly arc fault protection.

During sporadic arc fault conditions, the overload capability of the circuit breaker will not function since the root-mean-squared (RMS) value of the fault current is too small to actuate the automatic trip circuit. The addition of electronic arc fault sensing to a circuit breaker can add one of the elements required for sputtering arc fault protection—ideally, the output of an electronic arc fault sensing circuit directly trips and, thus, opens the circuit breaker. See, for example, U.S. Pat. Nos. 6,710,688; 6,542,056; 6,522,509; 6,522,228; 5,691,869; and 5,224,006.

The inclusion of arc fault detection electronics into standard, industry sized circuit breakers requires a unique approach to miniaturizing the overall packaging without introducing a significant negative effect on overall device robustness and reliability.

There is room for improvement in electrical switching apparatus and in housings and trip circuits therefor.

SUMMARY OF THE INVENTION

These needs and others are met by the present invention, in which a housing and a trip circuit cooperate to form a composite structure which comprises at least one printed circuit board and an over-molding material disposed thereon.

The invention employs molded housing halves that electrically and thermally insulate arc fault detection (AFD) electronics from a current carrying operating mechanism. The AFD electronics are over-molded to the molded housing halves using an over-molding material, such as, for example, a thermally conductive epoxy coating. Over-molding the AFD electronics to the molded housing halves eliminates the additional space required to package such electronics while providing superior strength, dielectric isolation and thermal heat transfer surface area.

In accordance with one aspect of the invention, an electrical switching apparatus comprises: a housing; separable contacts; an operating mechanism adapted to open and close the separable contacts; and a trip circuit cooperating with the operating mechanism to trip open the separable contacts, wherein the housing and the trip circuit cooperate to form a composite structure which comprises at least one printed circuit board and an over-molding material disposed thereon.

The housing may include a first housing portion and a second housing portion cooperating with the first housing portion to house the separable contacts and the operating mechanism therein.

The trip circuit may include a first printed circuit board and a second printed circuit board. The first and second housing portions may form a first surface disposed toward the separable contacts and the operating mechanism, and a second surface and a third surface opposite from the first surface. The first printed circuit board may be coupled to the second surface and the second printed circuit board may be coupled to the third surface.

The first and second housing portions may be adapted to electrically and thermally insulate the first and second printed circuit boards from the operating mechanism.

The first and second housing portions may be made of liquid crystal polymer thermoplastic.

The over-molding material may be a thermally conductive encapsulating material.

As another aspect of the invention, a circuit breaker comprises: a housing; separable contacts; an operating mechanism adapted to open and close the separable contacts; and a trip circuit cooperating with the operating mechanism to trip open the separable contacts, wherein the housing and the trip circuit cooperate to form an external composite structure which comprises at least one printed circuit board and an over-molding material disposed thereon.

The trip circuit may include a first printed circuit board and a second printed circuit board. The first and second printed circuit boards may be made of an FR4 electronics substrate having a thickness of about 0.018 inch (about 0.457 mm).

The trip circuit may include the at least one printed circuit board. The first and second housing portions may form a first surface disposed toward the separable contacts and the operating mechanism and a second surface opposite from the first surface. The at least one printed circuit board may be coupled to the second surface.

The housing may further include the over-molding material coupling the at least one printed circuit board to the second surface.

The over-molding material may be a thermally conductive encapsulating material, such as thermally conductive epoxy coating.

BRIEF DESCRIPTION OF THE DRAWINGS

A full understanding of the invention can be gained from the following description of the preferred embodiments when read in conjunction with the accompanying drawings in which:

FIG. 3 is an exploded isometric view of a portion of the circuit breaker of FIG. 1, which excludes the two arc fault detection (AFD) printed circuit boards of FIG. 4.

FIG. 4 is an isometric view of the portion of the circuit breaker of FIG. 3 including the operating mechanism housed within two housing halves and further including, in exploded isometric view, the two AFD printed circuit boards.

DESCRIPTION OF THE PREFERRED EMBODIMENTS

As employed herein, the statement that two or more parts are "connected" or "coupled" together shall mean that the parts are joined together either directly or joined through one or more intermediate parts.

As employed herein, the term "composite" means a generally solid material which comprises two or more substances and/or structures (e.g., without limitation, one or more printed circuit boards; an over-molding material) having different physical characteristics and in which each of such substances and/or structures retains its identity while contributing desirable properties to the whole.

The present invention is described in association with an aircraft or aerospace arc fault circuit breaker, although the invention is applicable to a wide range of electrical switching apparatus, such as, for example, circuit interrupters adapted to detect a wide range of faults, such as, for example, arc faults or ground faults in power circuits.

Figure 1:
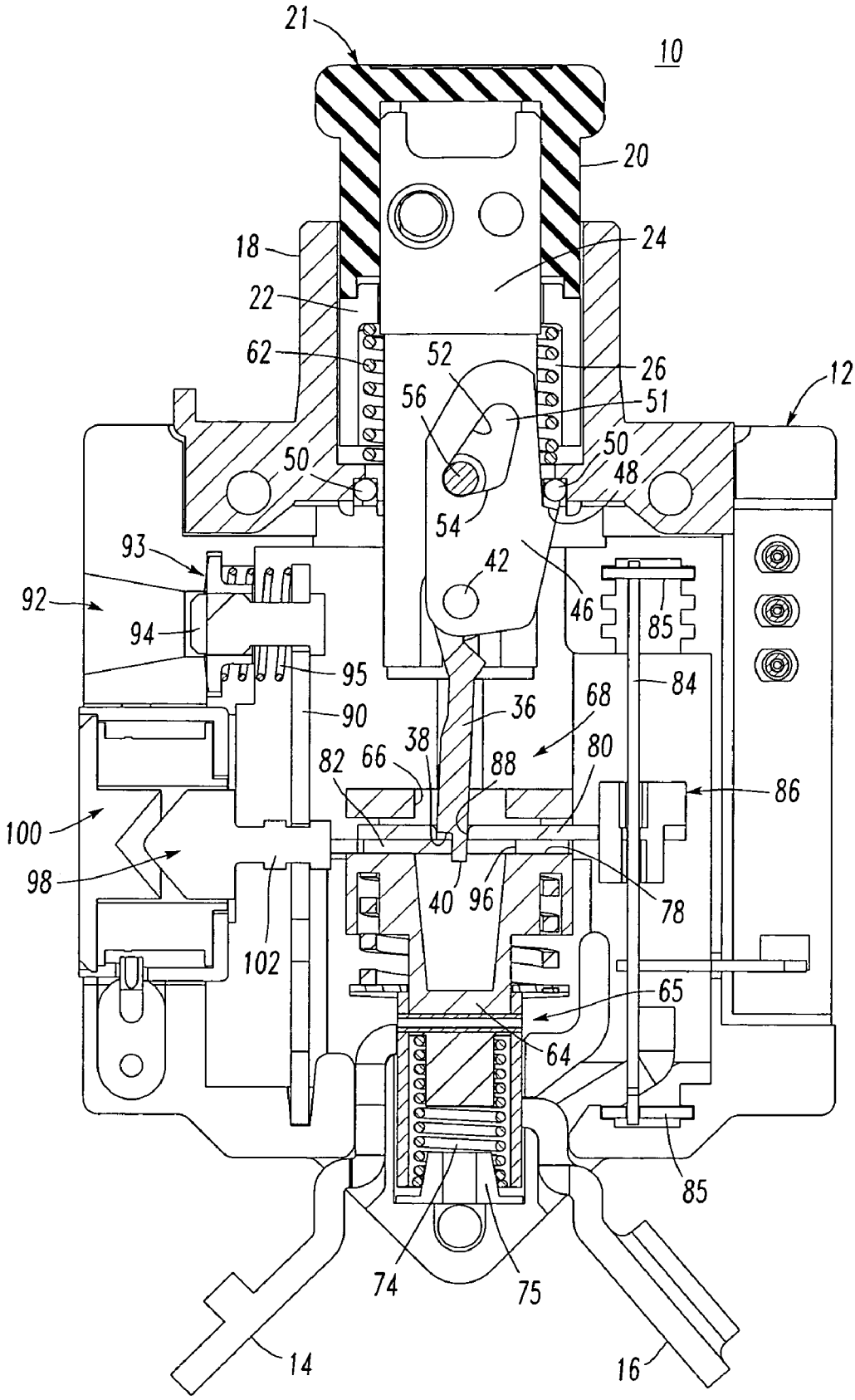
FIG. 1 is a cross-sectional view of the operating mechanism of a circuit breaker in accordance with the present invention.

Referring to FIG. 1, a circuit breaker 10 comprises an enclosure 12 having a pair of terminals 14 and 16 thereon which extend exteriorly of the enclosure 12 for electrical connection to an electrical source and load, respectively. A threaded, conductive ferrule 18 extends exteriorly of the enclosure 12 for the guidance of a manual operator 20 of a plunger assembly 21. The ferrule 18, in conjunction with a nut (not shown), provides a mounting and electrically conductive connection mechanism for the circuit breaker 10 on a panelboard (not shown).

The manual operator 20 is provided with a trip indicator 22. The manual operator 20 and trip indicator 22 are capable of sliding axial movement with respect to the ferrule 18. The manual operator 20 is provided with a central portion 24 having a central slot 26 extending approximately half the length thereof.

A clevis or thermal latch element 36 is provided with a latch surface 38 and a depending portion 40. The clevis 36 is pivotally supported by a pin 42 which is movable relative to the manual operator 20 in a slot (not shown). The end portions of the pin 42 are retained within grooves (not shown) in the central housing 12 which guide axial movement thereof.

The mechanical latch elements 46 (only one latch element 46 is shown in FIG. 1) are pivotally supported by the pin 42 and are accepted in the slot 26 in the manual operator 20. The latch elements 46 are provided with latching surfaces 48 (only one latching surface 48 is shown in FIG. 1) which are adapted to engage a cooperating latching surface 50 on the ferrule 18.

The mechanical latch elements 46 have camming apertures 51 (only one aperture 51 is shown) therein defining camming surfaces 52 (only one camming surface 52 is shown) which are disposed at an acute angle with respect to the axis of reciprocation of the manual operator 20 thereby to effect manual opening of the circuit breaker 10. Two lower camming surfaces 54 (only one camming surface 54 is shown) are disposed at substantially a right angle with respect to the axis of reciprocation of the manual operator 20 to provide positive locking of the circuit breaker 10. The central stem portion 24 carries a camming pin 56 which extends across the slot 26 therein and through the camming apertures 51 of the mechanical latch elements 46, in order to be in operative engagement therewith.

A spring 62 is provided to resiliently bias the manual operator 20, clevis 36 and latch elements 46 upwardly with respect to the ferrule 18.

Figure 2:
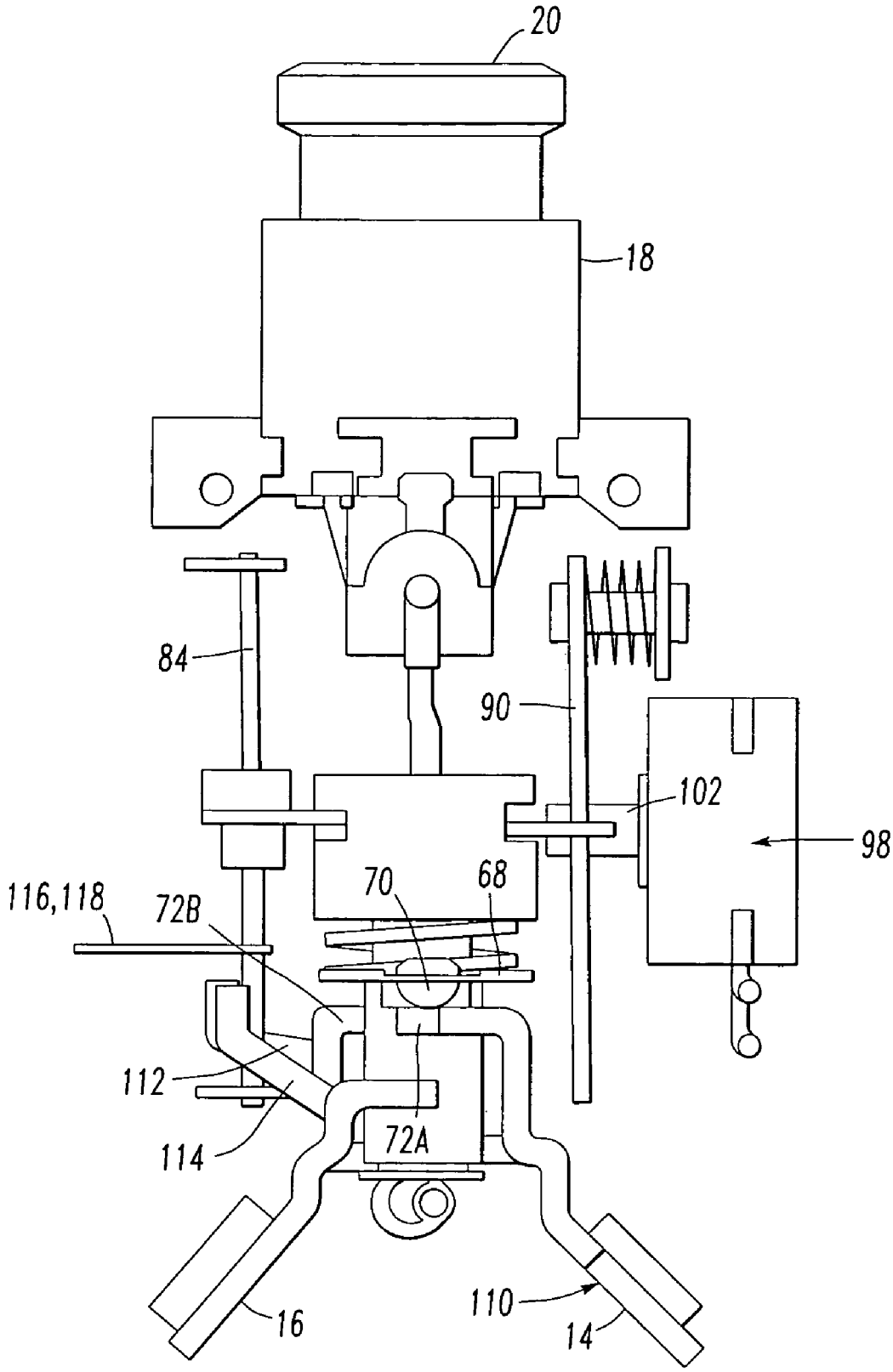
FIG. 2 is a vertical elevation view of the opposite side of the operating mechanism of FIG. 1.

A movable contact carrier or plunger 64 of a contact plunger assembly 65 has a central opening 66 therein for acceptance of the clevis 36. The contact carrier 64 carries a contact bridge 68 (shown in FIG. 2) having a pair of movable contacts 70 (only one contact 70 is shown in FIG. 2) positioned thereon. The movable contacts 70 are engageable with fixed contacts 72 (FIG. 2) to complete a circuit from terminal 14 to terminal 16 through a current responsive bimetal 84 of the circuit breaker 10, as will be described. A helical coil plunger return spring 74 abuts against a spring retainer portion 75 of the housing 12 at one end and the movable contact carrier 64 at its other end, in order to normally bias the contact carrier 64 upwardly relative to the housing 12.

The contact carrier 64 has a laterally extending slot 78 therein for the acceptance of a thermal or overload slide 80 and an ambient temperature slide 82. The overload slide 80 is movable internally of the contact carrier 64 under the influence of the elongated current responsive bimetal 84, which is retained within the housing 12 by end supports 85 at each end thereof.

A clevis guide assembly (e.g., made of ceramic) 86 couples the overload slide 80 to and insulates it from the bimetal 84. The overload slide 80 is provided with a slot 88 which accepts and closely cooperates with the clevis 36 to effect pivoting thereof in response to lateral movement of the slide 80.

The ambient temperature slide 82 underlies the overload slide 80 and is movable internally of the contact carrier 64 under the influence of an elongated ambient temperature compensating bimetal 90, which is part of an ambient compensator assembly 92 including an adjustable screw guide 93, a calibrate screw 94 and a compensator spring 95.

The ambient temperature compensating bimetal 90 is interlocked to the ambient temperature slide 82, whereby lateral movement of such slide 82 is controlled, in part, by such bimetal 90. The ambient temperature slide 82 is provided with a slot 96, which, when the circuit breaker 10 is in the contacts closed position, as shown, accepts the hooked end 40 of the clevis 36. In the contacts closed position, the latch surface 38 of the clevis 36 engages the upper surface of the ambient temperature slide 82 adjacent the periphery of the slot 96 with a pressure determined by the upward resilient bias provided by spring 74.

A miniature coil assembly 98 includes a coil 100 controlled by AFD PCB2 120 (FIG. 7) and a plunger 102. The plunger 102 is coupled to the ambient temperature slide 82, in order to effect an arc fault trip function therewith.

FIG. 2 shows the current path through the circuit breaker 10 of FIG. 1. When the contacts 70,72 are closed, the current path is established by a contact assembly 110 including the line terminal 14 and a first fixed contact 72A, the first movable contact 70 to the contact bridge 68 to the second movable contact 70 (not shown), the second movable contact 70 to a second fixed contact 72B, the second fixed contact 72B to a first leg (not shown) of the bimetal 84 by a first flexible conductor 112, through the bimetal 84 to a second leg (not shown) thereof to a second flexible conductor 114, and to the load terminal 16.

Figure 7:
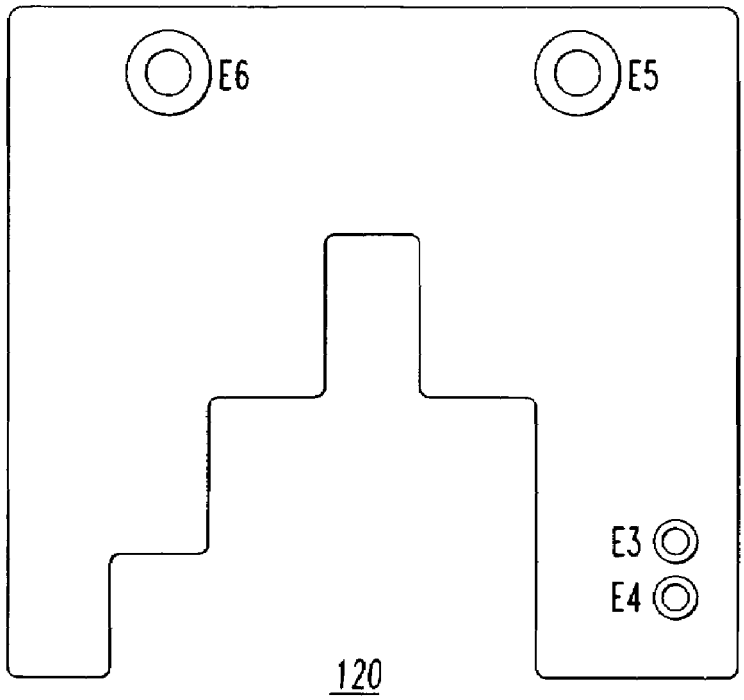
FIGS. 7 and 8 are plan views of the two AFD printed circuit boards of FIG. 4.
Figure 8:
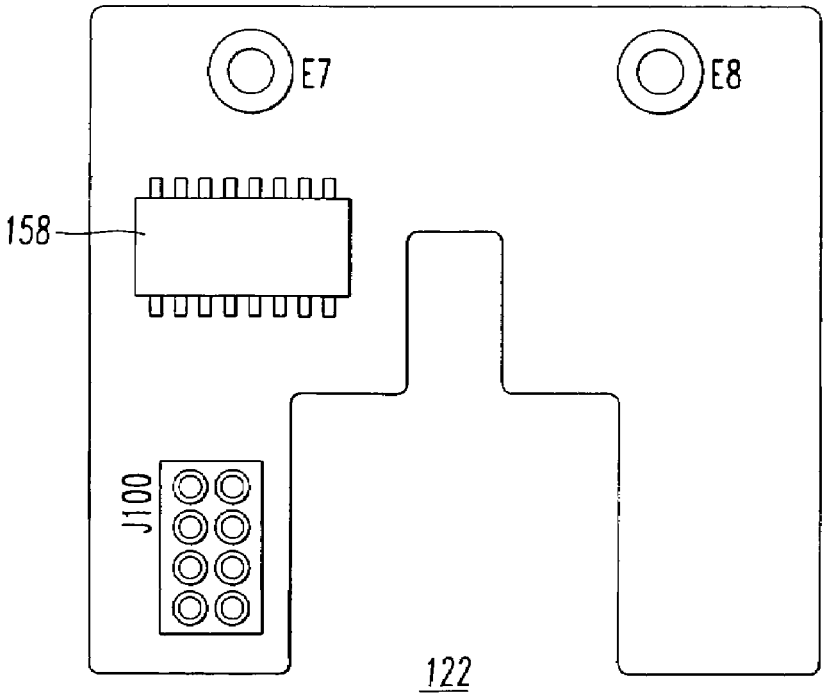

Additional conductors 116 and 118 respectively electrically connect the second bimetal leg (i.e., local ground; load terminal 16) to the AFD PCB2 120 (FIG. 7) and the first bimetal leg (i.e., a voltage signal representing the current through the bimetal 84) to AFD PCB1 122 (FIG. 8). These conductors 116,118 electrically connect PCB1 122 and PCB2 120 across the bimetal 84, in order to sense current flowing to or from the load terminal 16.

Referring to FIG. 3, the enclosure 12 (FIG. 1) includes a lower case half 130 and an upper case half 132. The internal operating mechanism 134 is electrically and thermally insulated from the AFD electronics 120,122 (FIG. 4). The housing halves 130,132 are preferably made from liquid crystal polymer thermoplastic, which may be molded to provide relatively very thin walls (e.g., without limitation, less than about 0.010 in. (about 0.254 mm)) with an irregular wall thickness and a relatively complex geometry, thereby providing superior strength and temperature insulation characteristics. The housing halves 130,132 also electrically and thermally insulate the AFD electronics 120,122 from the current carrying operating mechanism 134.

The electrical conductors, such as three pins or terminal couplers 136,138,140, and the two electrical conductors 116,118 (FIGS. 2 and 13), such as sensing wires, provide a trip signal, a local ground from the load terminal 16, power (e.g. +5 VDC), a signal from the first bimetal leg towards the separable contacts 70,72 and away from the load terminal 16, and the second bimetal leg providing the local ground. The three pins 136,138,140 include: (1) the trip signal from the PIC processor 158 on PCB1 122 to PCB2 120, (2) the load terminal 16 (the local ground) from PCB2 120 to PCB1 122, and (3)+5 VDC from PCB2 120 to PCB1 122. The electrical connections of the conductors 116,118 are made at feed through holes (not shown) of the respective PCBs 120,122 (FIGS. 7 and 8).

The power coil 100 of the miniature coil assembly 98 is disposed through the housing halves 130,132, in order to provide improved heat transfer to the surrounding air.

Two screws 146,148 and two corresponding nuts 150,152 mechanically hold the housing halves 130,132 and the two AFD printed circuit boards 120,122 (FIG. 4) and provide the neutral or frame reference thereto from the bezel 18 (FIG. 1).

FIG. 4 shows the internal operating mechanism 134 (FIG. 3) packaged within the housing halves 130,132, with the AFD electronics 120,122 being shown in an exploded isometric view. Preferably, the AFD printed circuit boards 120 (FIG. 7) and 122 (FIG. 8) are made of a relatively minimal FR4 electronics substrate (e.g. without limitation, about 0.018 in. (about 0.457 mm) thickness). In contrast, typical printed circuit board thicknesses are about 0.031 in. (about 0.787 mm) to about 0.062 in. (about 1.575 mm). The AFD printed circuit boards 120,122 are then positioned using locating screws 146,148 (FIG. 3) prior to over-molding as is discussed, below, in connection with FIG. 5. The over-molding of the AFD electronics 120,122 provides the structural and overall package integrity as may be employed, for example, for aerospace use. The housing halves 130,132 are further secured by a semi-tubular rivet 154.

Figure 5:
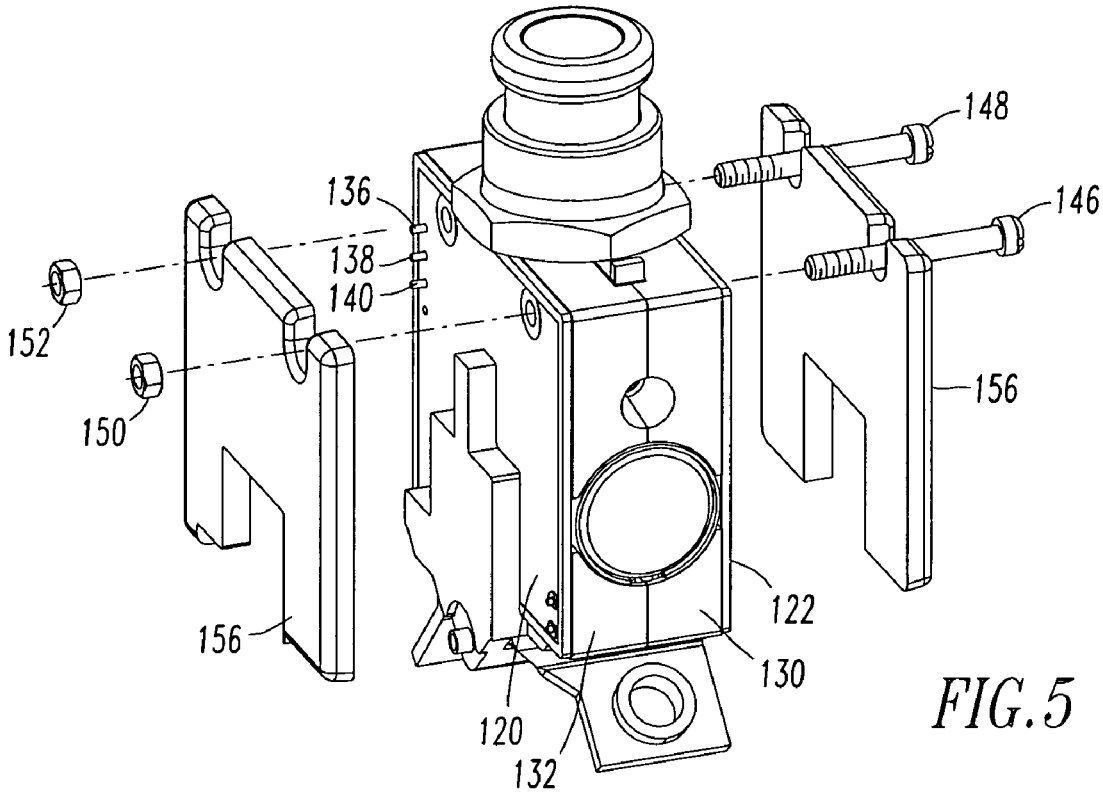
FIG. 5 is an isometric view of the circuit breaker portion of FIG. 4 with the two AFD printed circuit boards in position prior to an over-molding operation which provides the outer base structure of FIG. 6.

FIG. 5 shows the AFD electronics 120,122 in position prior to the over-molding operation. For example, by employing a thermally conductive encapsulating material 156 (shown exploded for convenience of reference, but after being over-molded) for over-molding, this provides better heat transfer to the surrounding air, increased dielectric protection compared to free air, and superior mechanical integrity of the entire structure. The overall package is minimized using this approach compared to conventional AFCI circuit breakers. This method most importantly shields the AFD electronics 120,122 from common environmental failures, such as, for example, vibration, excessive temperature and dielectric breakdown.

Examples 1 and 2, below, are examples of different over-molding processes suitable for use with the disclosed circuit breaker 10.

EXAMPLE 1

First, the internal mechanism, including, for example, the operating mechanism 134, is built into the case halves 130,132 as shown in FIG. 3. Next, the PCBs 120,122 are coupled to the respective case halves 132,130 by employing the screws 146,148 and the nuts 150,152 as shown in FIG. 5. Then, all electrical connections, such as, for example, solder, pin and wire connections, are made prior to over-molding. A suitable gap filler (not shown) is employed to prevent the over-molding material from entering the internal operating mechanism 134. Next, the assembled device is inserted into suitable mold tooling (not shown) using the screws 146,148 and rivet 154 for proper location and orientation. Then, suitable over-molding material is injected into the mold tooling. For example, suitable vacuum assist or pressurized injection methods may be employed. The over-molding material fills all open voids, thus, encapsulating the PCBs 120,122, wire connections on the side of the device (FIG. 13), and via/holes thru the PCBs 120,122, in order to assist in mechanically coupling to the respective case halves 132,130. Finally, the circuit breaker 10 is removed from the mold tooling and is de-flashed as needed.

EXAMPLE 2

Figure 13:
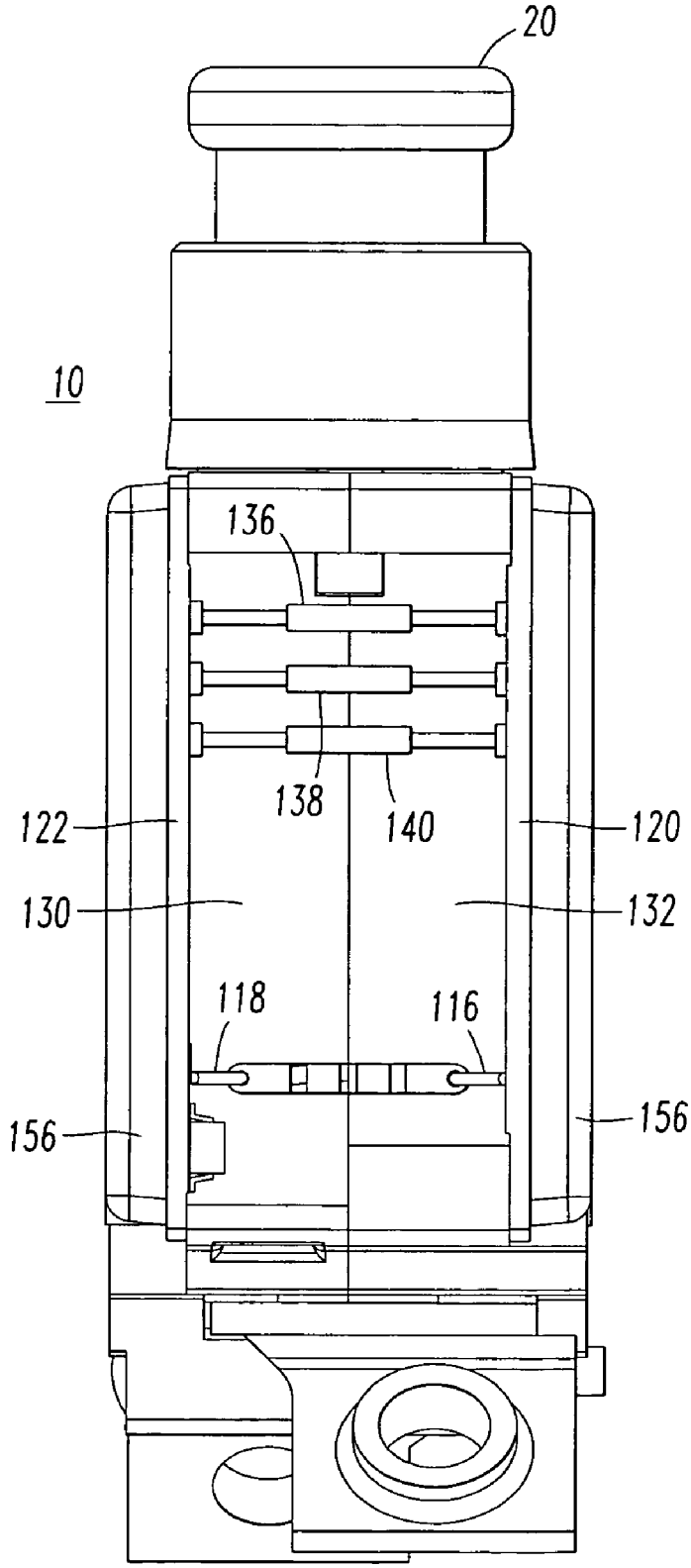
FIG. 13 is a side vertical elevation view of the circuit breaker of FIG. 1.

As an alternative to Example 1, the case halves 130,132 and PCBs 120,122 are inserted into a suitable mold tooling (not shown) as individual entities. Locating holes on the case halves 130,132 and PCBs 120,122 are employed for location within the mold tooling. Next, over-molding material is injected into the mold tooling. Vacuum assist or pressurized injection methods may be employed. The over-molding material fills all open voids, thus, encapsulating the PCBs 120,122 and providing a method of joining and sealing the PCBs 120,122 to the respective case halves 132,130. This method also employs via/holes thru the PCBs 120,122 to assist in mechanical coupling. Next, the internal operating mechanism 134 is built into the sub-assembly formed by the PCBs 120,122 and case halves 130,132. Then, all solder, pin and wire electrical connections are made. Finally, a secondary cover (not shown) is applied to protect the side opening (FIG. 13).

Figure 6:
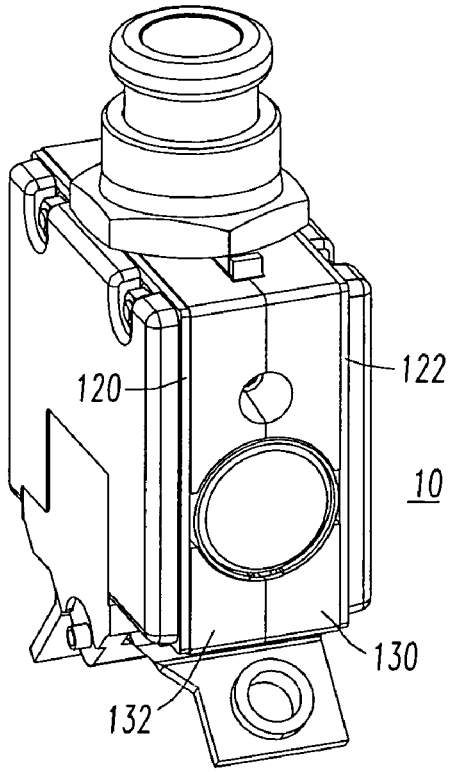
FIG. 6 is an isometric view of the circuit breaker of FIG. 4 including the outer base structure, which is chemically and mechanically coupled to the two AFD printed circuit boards, by the over-molding operation.

FIG. 6 shows the assembled circuit breaker 10 with the AFD electronics 120,122 (FIG. 5) being chemically and mechanically linked to the base structure of the respective housing halves 132,130, thereby providing an overall compact and robust electro/mechanical package.

FIGS. 7 and 8 show the two AFD printed circuit board assemblies 120 and 122, respectively, of FIG. 4. The neutral (or, more accurately, the aircraft frame from the bezel 18 of FIG. 1) is electrically connected by the two screws 146,148 (FIG. 3) to both of the PCBs 120,122 at pads E5,E6,E7,E8. The PCBs 120,122 derive power from voltage between the neutral or frame at pads E5,E6,E7,E8 (FIGS. 7 and 8) and the local ground, which is the same potential as the load terminal 16 (FIG. 1).

The J100 area of PCB1 122 with the PIC processor 158 is employed for programming.

Figure 9:
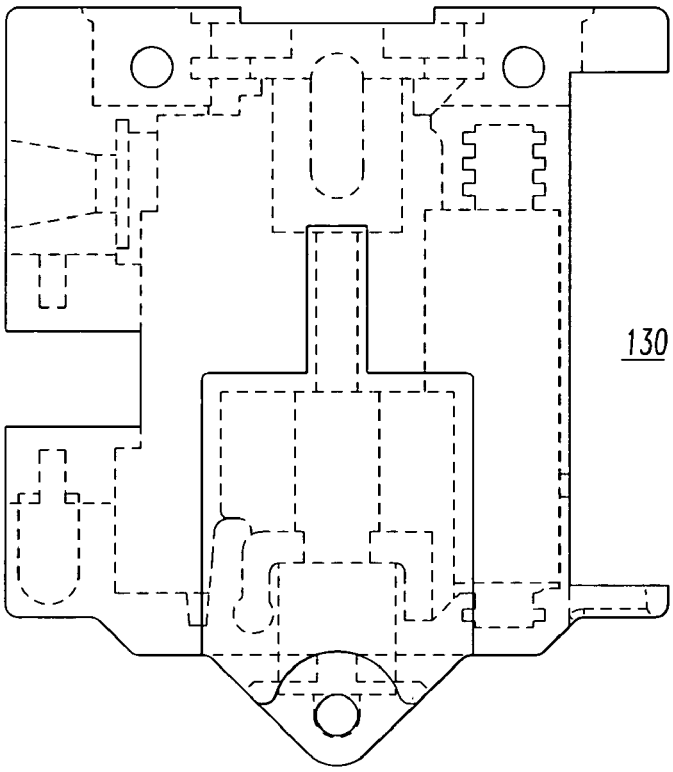
FIGS. 9 and 10 are top plan views of the two housing halves of FIG. 3.
Figure 10:
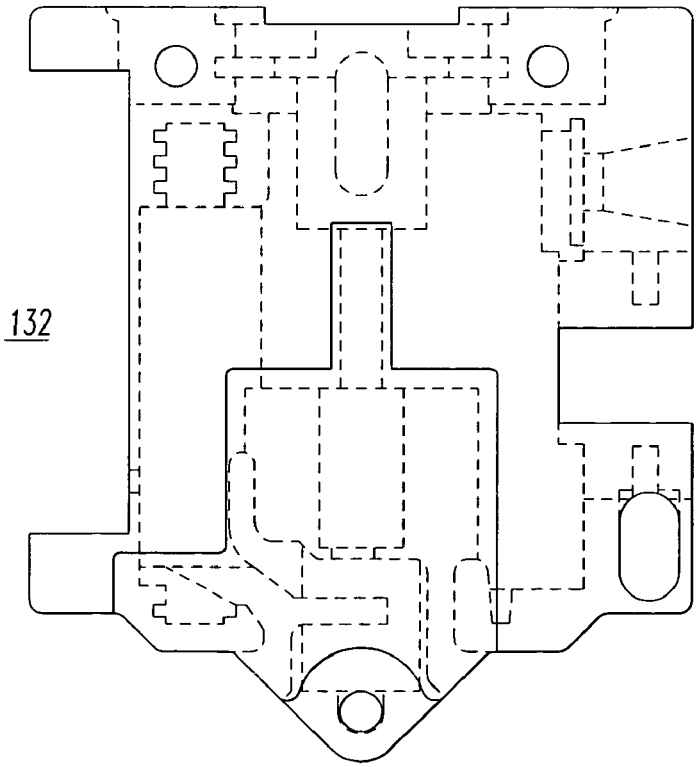
Figure 11:
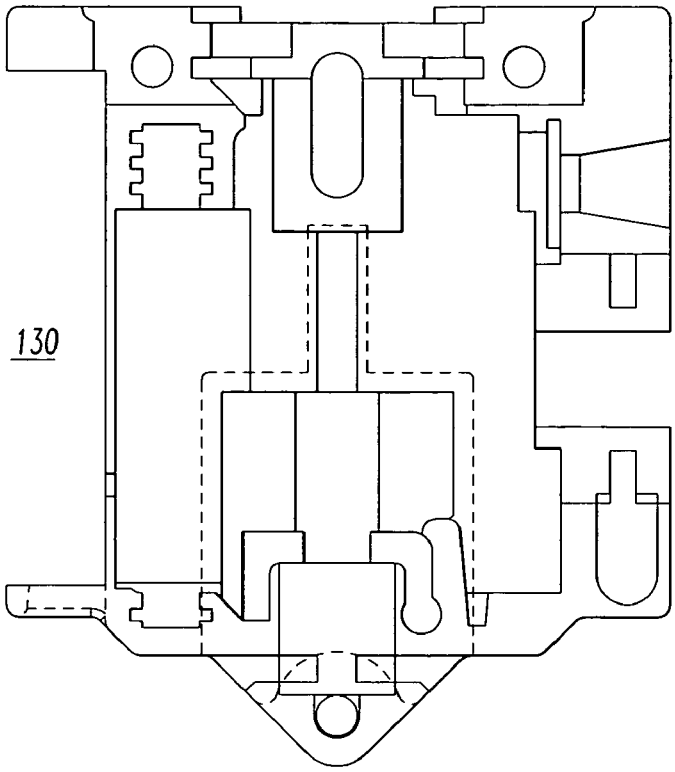
FIGS. 11 and 12 are bottom plan views of the two housing halves of FIG. 3.
Figure 12:
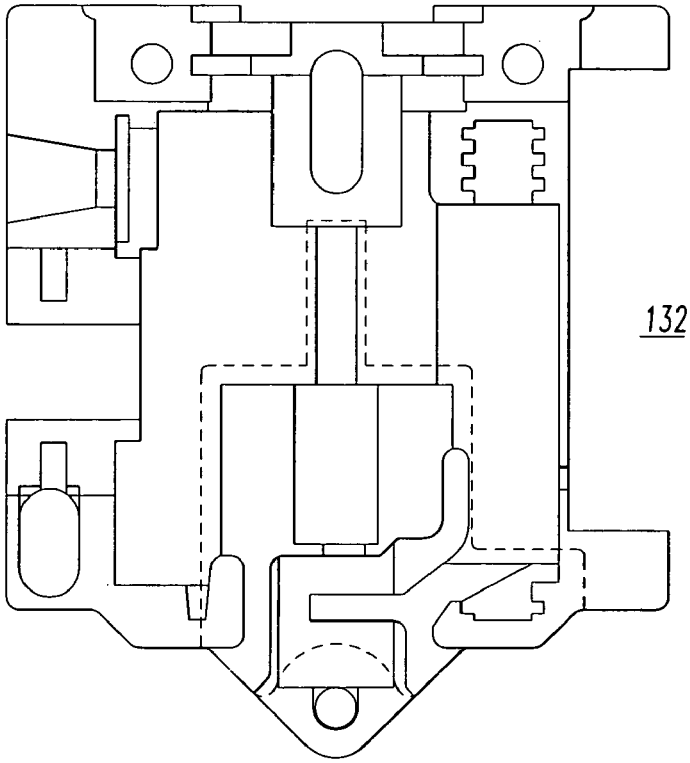

FIGS. 9 and 11 show the lower housing half 130, and FIGS. 10 and 12 show the upper housing half 132 of FIG. 3.

As shown in FIG. 13, the two housing halves 130,132 are both open on one end. For convenience of reference, the three terminal couplers 136,138,140 and the electrical conductors 116,118 are shown exposed, although those components are encapsulated by the over-molding material 156.

The composite structure formed by bonding the AFD printed circuit boards 120,122 (e.g., made of FR4; glass base epoxy binder) and the over-molding material 156 (e.g., made of thermally conductive epoxy coating; a suitable over-molding compound; a suitable potting material) provides improvements in thermal conductivity of the heat of the AFD electronics to the surrounding air through the thermally conductive epoxy coating. Over-molding the two AFD printed circuit boards 120,122 to the molded housing halves 130,132 also eliminates the additional space required to package the AFD electronics while providing superior strength, dielectric isolation and thermal heat transfer surface area. Furthermore, the housing halves 130,132 provide thermal isolation of the AFD electronics 120,122 from the internal operating mechanism 134 (FIG. 2), such as, for example, in particular, the bimetal 84 and the associated electrical power conductors.

It will be appreciated that a suitable trip circuit may implement, for example, the AFD electronics 120,122 in a combination of one or more of analog, digital and/or processor-based circuits, and/or in combination with one or more printed circuit boards (PCBs). Although an example operating mechanism 134 is disclosed, a wide range of suitable operating mechanisms for electrical switching apparatus may be employed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus comprising:

a housing;

separable contacts;

an operating mechanism adapted to open and close said separable contacts; and a trip circuit cooperating with said operating mechanism to trip open said separable contacts, wherein said housing and said trip circuit cooperate to form a composite structure which comprises at least one printed circuit board and an over-molding material disposed thereon.

2. The electrical switching apparatus of claim 1 wherein said housing comprises a first housing portion and a second housing portion cooperating with said first housing portion to house said separable contacts and said operating mechanism therein.

3. An electrical switching apparatus comprising:

a housing;

separable contacts;

an operating mechanism adapted to open and close said separable contacts; and a trip circuit cooperating with said operating mechanism to trip open said separable contacts, wherein said housing and said trip circuit cooperate to form a composite structure which comprises at least one printed circuit board and an over-molding material disposed thereon, wherein said housing comprises a first housing portion and a second housing portion cooperating with said first housing portion to house said separable contacts and said operating mechanism therein, wherein said trip circuit comprises a first printed circuit board and a second printed circuit board; wherein said first and second housing portions form a first surface disposed toward said separable contacts and said operating mechanism, and a second surface and a third surface opposite from said first surface; and wherein said first printed circuit board is coupled to said second surface and said second printed circuit board is coupled to said third surface.

4. The electrical switching apparatus of claim 3 wherein said first and second housing portions are adapted to electrically and thermally insulate said first and second printed circuit boards from said operating mechanism.

5. The electrical switching apparatus of claim 2 wherein said first and second housing portions are made of liquid crystal polymer thermoplastic.

6. The electrical switching apparatus of claim 1 wherein said over-molding material is a thermally conductive encapsulating material.

7. A circuit breaker comprising:

a housing;

separable contacts;

an operating mechanism adapted to open and close said separable contacts; and a trip circuit cooperating with said operating mechanism to trip open said separable contacts, wherein said housing and said trip circuit cooperate to form a composite structure which comprises at least one printed circuit board and an over-molding material disposed thereon, and wherein said over-molding material is external to said housing.

8. The circuit breaker of claim 7 wherein said housing comprises a first housing portion and a second housing portion cooperating with said first housing portion to house said separable contacts and said operating mechanism therein.

9. The circuit breaker of claim 8 wherein at least a portion of said first and second housing portions includes a structure disposed intermediate: said separable contacts and said operating mechanism, and said at least one printed circuit board.

10. A circuit breaker comprising:

a housing;

separable contacts;

an operating mechanism adapted to open and close said separable contacts; and a trip circuit cooperating with said operating mechanism to trip open said separable contacts, wherein said housing and said trip circuit cooperate to form an external composite structure which comprises at least one printed circuit board and an over-molding material disposed thereon, wherein said housing comprises a first housing portion and a second housing portion cooperating with said first housing portion to house said separable contacts and said operating mechanism therein, wherein said trip circuit comprises a first printed circuit board and a second printed circuit board; wherein said first and second housing portions form a first surface disposed toward said separable contacts and said operating mechanism, and a second surface and a third surface opposite from said first surface; and wherein said first printed circuit board is coupled to said second surface and said second printed circuit board is coupled to said third surface.

11. The circuit breaker of claim 10 wherein said first and second printed circuit boards are made of an FR4 electronics substrate having a thickness of about 0.018 inch.

12. The circuit breaker of claim 10 wherein said housing further comprises two fasteners coupling said first housing portion, said second housing portion and said first and second printed circuit boards.

13. The circuit breaker of claim 10 wherein said operating mechanism comprises a plurality of electrical conductors electrically connected between said first and second printed circuit boards.

14. A circuit breaker comprising:

a housing;

separable contacts;

an operating mechanism adapted to open and close said separable contacts; and a trip circuit cooperating with said operating mechanism to trip open said separable contacts, wherein said housing and said trip circuit cooperate to form an external composite structure which comprises at least one printed circuit board and an over-molding material disposed thereon, wherein said housing comprises a first housing portion and a second housing portion cooperating with said first housing portion to house said separable contacts and said operating mechanism therein, wherein said trip circuit comprises said at least one printed circuit board; wherein said first and second housing portions form a first surface disposed toward said separable contacts and said operating mechanism and an external second surface opposite from said first surface; and wherein said at least one printed circuit board is coupled to said external second surface.

15. The circuit breaker of claim 14 wherein said first and second housing portions are adapted to electrically and thermally insulate said at least one printed circuit board from said operating mechanism.

16. The circuit breaker of claim 15 wherein said first and second housing portions are made of liquid crystal polymer thermoplastic.

17. The circuit breaker of claim 15 wherein said first and second housing portions include a structure disposed intermediate: said separable contacts and said operating mechanism, and each of said at least one printed circuit board.

18. The circuit breaker of claim 14 wherein said housing further comprises said over-molding material coupling said at least one printed circuit board to said external second surface.

19. The circuit breaker of claim 18 wherein said over-molding material is a thermally conductive encapsulating material.

20. The circuit breaker of claim 19 wherein said thermally conductive encapsulating material is a thermally conductive epoxy coating.

21. An electrical switching apparatus comprising:

a housing;

separable contacts;

an operating mechanism adapted to open and close said separable contacts; and a trip circuit cooperating with said operating mechanism to trip open said separable contacts, wherein said housing and said trip circuit cooperate to form a permanent composite structure which comprises at least one printed circuit board and an over-molding material disposed thereon.

22. The circuit breaker of claim 21 wherein said permanent composite structure is solid.

23. The circuit breaker of claim 21 wherein said over-molding material is bonded to said at least one printed circuit board.

* * * * *